US006059182A

United States Patent [19]

Wein

[11] Patent Number: 6,059,182

[45] Date of Patent: May 9, 2000

[54] SEALABLE CARTON WITH IMPROVED 4-PLY SPOUT AND METHOD OF MAKING SAME

[76] Inventor: Sam Wein, 3355 Genoa Way, Suite 128, Oceanside, Calif. 92056

[21] Appl. No.: 09/310,233

[22] Filed: May 12, 1999

[51] Int. Cl.[7] ..... B65D 5/74

[52] U.S. Cl. ..... 229/219; 229/217; 229/930; 493/128; 493/151; 493/156; 493/183

[58] Field of Search ..... 229/132, 217, 229/219, 234, 930; 493/84, 128, 141, 150, 151, 156, 183

[56] References Cited

U.S. PATENT DOCUMENTS

| | | | |
|---|---|---|---|
| 1,606,439 | 11/1926 | Metzger | 229/217 |
| 2,069,281 | 2/1937 | Sebreny | 229/219 |
| 2,898,026 | 8/1959 | Aid | 229/132 |
| 2,989,224 | 6/1961 | Umanoff | 229/217 |
| 3,140,809 | 7/1964 | Hickin et al. | 229/132 |
| 3,328,189 | 6/1967 | Bauer | 229/132 |
| 3,411,695 | 11/1968 | Cupo | 229/132 |
| 3,438,565 | 4/1969 | Lugt et al. | 229/234 |
| 4,816,306 | 3/1989 | Brady et al. | 229/132 |
| 5,452,850 | 9/1995 | Allsop | 229/219 |

FOREIGN PATENT DOCUMENTS

| | | | |
|---|---|---|---|
| 2264286 | 8/1993 | United Kingdom | 229/132 |

*Primary Examiner*—Gary E. Elkins
*Attorney, Agent, or Firm*—Richard D. Clarke; George T. Parsons

[57] ABSTRACT

A novel box construction is provided having a numerous sealing features therein to provide a waterproof and sift resistant container. A first sealing feature is a pouring spout of three or four plies, the first and second plies of which provide a way for opening the spout. The construction of the spout also allows improved sealing because of its snap open and close feature. A second sealing feature uses transverse scoring of numerous panels and flaps with the scoring formed at the juncture between adjacent panels and flaps during manufacture and before assembly. A third sealing feature is the application of heat activated contact glue in several different patterns, including surrounding the spout with a glue border, applying "L"-shaped glue patterns on the perimeter of one panel, adding a glue border around almost the entire perimeter of one panel, and finally, applying glue on entire bottom panels and dust flaps.

12 Claims, 8 Drawing Sheets

SEALABLE CARTON WITH IMPROVED 4-PLY SPOUT AND METHOD OF MAKING SAME

BACKGROUND OF THE INVENTION

1. Field of the Invention

The present invention relates generally to fibrous structures, and more particularly to a paperboard carton, container or box which has an improved spout and improved sealing features, thereby providing a sealable waterproof box which is readily manufactured and is also less costly to manufacture.

2. Description of the Related Art

The container art field includes many different structures designed to hold objects, fluids and granular or flake-like materials. More specifically, these structures, or containers, are intended to protect the contents from falling or flowing out of the container until required. In addition, these containers, typically in the form of boxes, are frequently meant to keep the contents fresh and relatively dry until required, including such contents as cereals, powders, and grains. Many times, the design of these boxes use fibrous materials, such as cardboard, paper board, or corrugated construction.

Naturally, some means are designed in to enable the user to open the container. Just a few of the previous designs include spouts of various materials and shapes, perforated portions for punching out or through, adhesive covers to spouts or perforated portions, pull-out metal pour spouts, and plastic caps. Although past box designs and attempts at effective sealing have apparently been sufficient to a certain degree, numerous problems have been experienced by the users, even today, after so many years of searching for workable solutions.

Some spout or cap designs are expensive because of the materials or the manufacturing complexity. Some openings, such as perforations, or adhesive covers, do not allow for a well-sealed box. The cover cannot be closed again. Therefore, the contents become stale much quicker, are easily susceptible to moisture ruining the contents, or lumping occurs, preventing the contents from flowing out of the box at all. The user sometimes resorts to tearing the box apart just to adequately remove the contents.

Therefore, it is clear that a need exists for an improved box design which is easily opened, equally easy to seal to protect the contents, and is also economical to manufacture.

One attempt to address these problems in the prior art is Brink et al., U.S. Pat. No. 5,531,376. This patent discloses a paperboard pour spout. Unfortunately, the pour spout design, although having some advantages over prior art, is a complex design compared to the present inventive spout. In addition, the Brink spout does not have other advantages of the present invention, namely the improved spout and waterproofing features. Finally, Brink et al. does not address the long felt need for other improvements to sealing features.

In a series of successful attempts to overcome some of these difficulties mentioned above, the present inventor has been granted numerous U.S. patents. Wein U.S. Pat. No. 4,953,707 discloses a box with an improved pouring arrangement. Although this arrangement provides for an improved sealing capability, the present inventor has designed additional unique improvements for sealing. Wein U.S. Pat. No. 5,044,503 discloses a box gluing arrangement for improved closures. Although this arrangement also provides for an improved sealing capability, the present inventor herein has designed additional unique gluing arrangements.

Finally, Wein U.S. Pat. No. 5,816,486 discloses a container with sealing features with an improved moisture resistant and sift-resistant container. More specifically, a pouring spout of three layers is disclosed along with a hot melt glue pattern in a generally rectangular pattern. Despite this third patent, the Applicant, has invented an improved novel spout, plus further novel improvements have been made to the gluing pattern for a box.

SUMMARY OF THE INVENTION

The above-mentioned difficulties and problems of the prior art are overcome by the present invention. Briefly stated, the present invention provides novel improvements to a box for sealing the contents against moisture, and unwanted leakage of the contents. In summary, the present invention represents a box having several unique sealing features. No longer will the user have to discard purchases because of inedible or unusable contents. No longer will the manufacturer of the boxes have to manage so many parts and assemblies. And no longer will the user be as frustrated with difficult to open and difficult to seal boxes.

More specifically, the present invention includes an improved multi-layer fibrous material, paperboard or cardboard spout which snaps open and snaps closed providing a relatively tight seal which reduces moisture and prevents contents from leaking. In addition, this invention includes an improved box pattern for more efficient manufacture and better sealing by using male and female scoring on opposite sides of the pattern.

Finally, this invention includes a unique gluing improvement for covers and dust flaps that more effectively seals the box after assembly. These unique improvements also mean that the frequent use of a paper-like or waxed paper type inner bag can be virtually eliminated from the manufacturing or assembly process, thereby significantly reducing costs. At the same time, the great user frustration of opening and resealing such an inner bag, usually a wax-paper bag, is also eliminated.

Even more specifically, the box has two side panels, a top panel, a bottom panel, and two end panels. The spout is formed from at least three layers, or plies, of fibrous material, cardboard or similar appropriate material. The preferred spout for durability of function and waterproofing features is a 4-ply construction. The first, and outer layer, has a flap pivotal about one edge of the layer. The first layer overlays part of the second layer. The second layer is also pivotal about one edge of this layer. Means are also provided in this second layer for lifting the flap. Just one novel feature of the second layer, and therefore, the spout, is the design of the second layer. Two wing flaps at opposite ends of this second layer include scored junctures allowing the wing flaps to bend during opening or closing of the spout. A second means for bending the wing flaps are provided through perforations located near the opposite ends of the wing flaps. The third layer has an opening for pouring contents of the box. The opening is covered by the second layer when the spout is closed.

To achieve an open position, the first flap in the first layer is pivoted about one edge, then the second flap is pivoted about one edge of this second flap. As the second flap is pivoted, the wing flaps are bent at the previously mentioned junctures and virtually simultaneously at the perforations. This pivoting of the first and second layers reveals the opening in the third layer to permit dispensing of the box contents. Moreover, the spout when opened locks in the open position, because of its novel construction, and will not inadvertently close when a user is actively pouring contents from the box. Likewise, when closed, this novel spout design locks closed and will not inadvertently open when the open position is not desired. In this way, the novel spout facilitates staying locked open for certain pouring and locks in the closed position so container contents will not spill out when the container is tipped or topples over.

Furthermore, the novel spout design enables spouts of varying size to be constructed. Spouts with an outer finger notch for opening by a user can be made in large and very large sizes to accommodate dispensing of larger particles stored within the container, such as corn flakes or other large particle contents. Even when very much enlarged, the spout still locks in the open and closed positions to facilitate certain pouring and eliminating unwanted content leaking or spilling.

The second sealing feature is male and female scoring formed in the flat pattern of the box during manufacture and before gluing, folding and final assembly. Transverse female scores and transverse male scores are formed at the juncture between adjacent panels of the box. The result of this complimentary scoring during the box assembly operation is that each transverse male scoring mates securely into a channel of each transverse female scoring. Therefore, easier, more rapid, and more efficient manufacture results, costs are significantly reduced, and a better container seal is provided following assembly with reverse scoring.

A third sealing feature is applying hot melt glue in several different novel patterns, including surrounding the spout opening with a glue border, applying "L"-shaped glue patterns on the perimeter of one panel, adding a glue border around the perimeter of one panel, and finally, applying glue on an entire panel. These novel glue patterns are also applied during box manufacture to the surface of applicable dust flaps. In other words, portions of the top panel, the bottom panel and the dust flaps have hot melt glue applied. Just one advantage of this glue pattern is waterproofing, based in part on added glue, plus the close proximity of the glue pattern to the various perimeters.

These, and other features and advantages of the present invention are set forth more completely in the accompanying drawings and the following description.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein closely related elements have the same number but different alphabetical suffixes, and further wherein.

DESCRIPTION OF THE PREFERRED EMBODIMENTS

Figure 1:
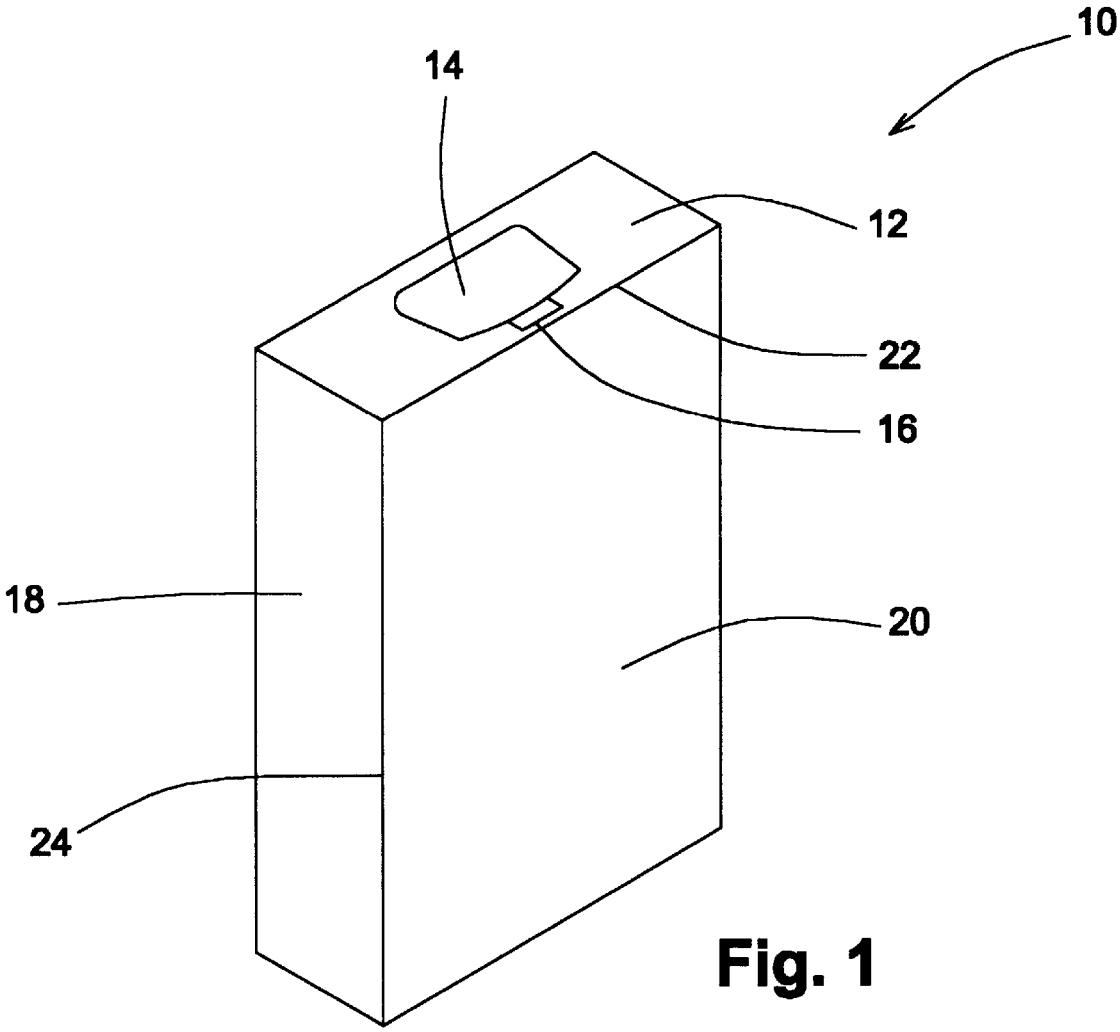
FIG. 1 is a perspective representation showing a fully assembled box of the present invention with an enlarged spout on a top panel of the box.

Referring initially to FIG. 1, a perspective representation of a box 10 is shown illustrating the fully assembled container of the present invention. The box 10 is manufactured from a single piece of fibrous structure, such as cardboard, although other materials may be used. When assembled, the box 10 has two end panels, two side panels, and a top and bottom panel, a total of six sides. A typical top panel 12 is shown with a preferred embodiment of an improved enlarged pouring spout 14 incorporated. The enlarged spout 14 is preferably centrally located on the top panel 12 of box 10. Integral to the spout 14 is an outer recess 16 to accommodate the users finger in opening the spout. This recess 16 allows a user to easily open the spout 14 with virtually one finger. Adjacent to and foldably connected to the top panel 12 is an end panel 18 and a typical side panel 20. The side panel 20 is connected to the end panel 18 at a top perimeter 22. The top panel 12 is connected to the side panel 20 at a side perimeter 24. Not shown in FIG. 1 are the opposite panels, that is, a second end panel, a second side panel and a bottom panel. The bottom panel is opposite to the top panel 12 at the other end of the box 10. Therefore, it is clear by extension of the previous discussion, that each end panel 18 is adjacent to and foldably connected to two side panels 20, the top panel 12 and the bottom panel (not shown). Another way of describing the construction of the box 10 is to state that before assembly, the entire box 10, when laid flat, is one continuous piece of material.

Figure 2:
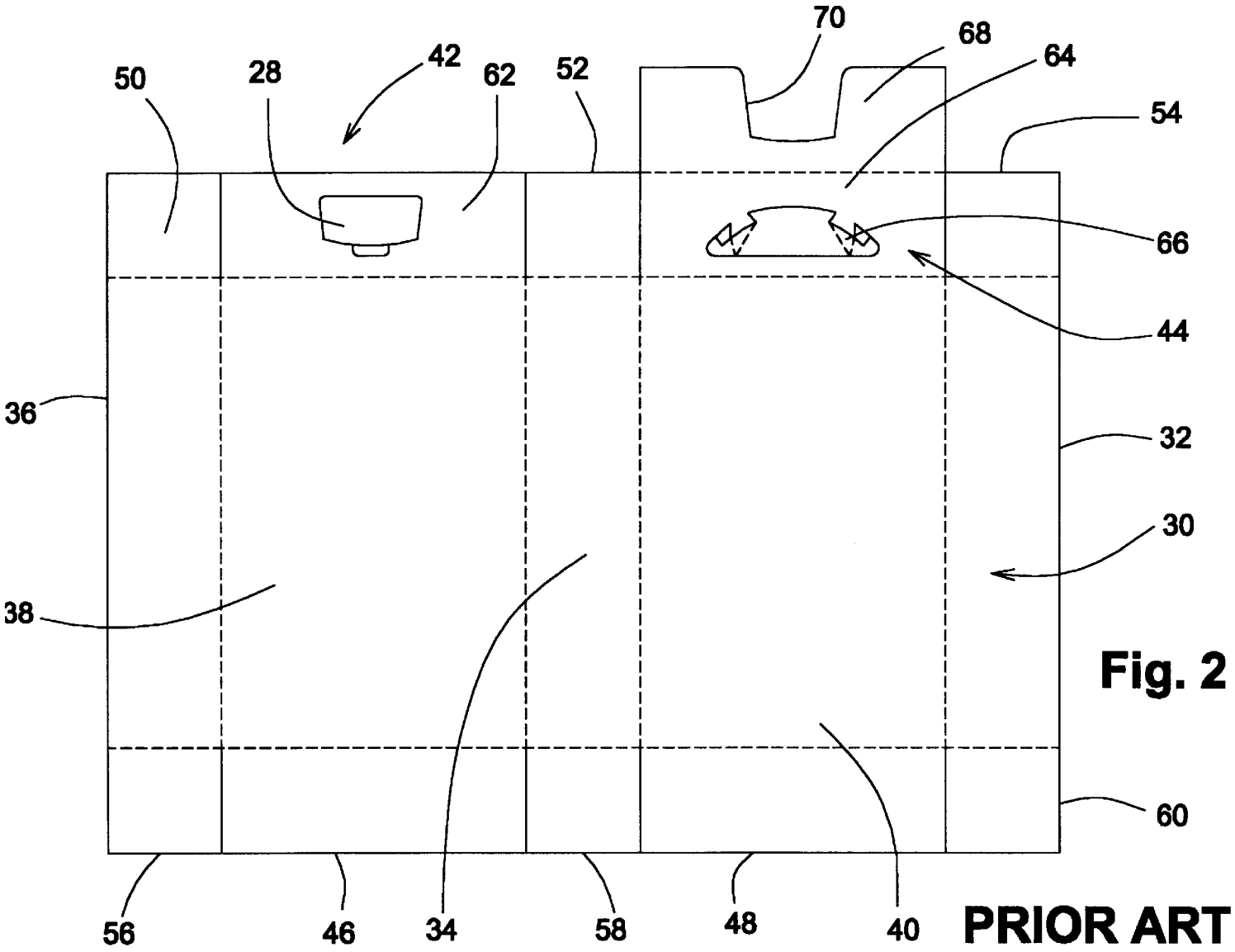
Fig. 2 PRIOR ART
FIG. 2 is a schematic representation of a prior art box construction pattern in a flat open position, illustrating a 3-ply spout and material pattern.

Referring next to FIG. 2 is a schematic representation of a prior art unfolded box 26 in a flat open position, illustrating a 3-ply small spout 28 and a larger, more paperboard consuming material pattern 30. More specifically, the large material pattern 30 is comprised of a first, second and third end panel 32, 34, and 36 foldably connected to a first and second side panel 38, and 40, which in turn are foldably connected to a first and second upper panel 42, and 44, a first and second bottom panel 46, and 48, and six dust flaps 50, 52, 54, 56, 58, and 60.

Continuing with FIG. 2, the smaller prior art spout 28 is centrally located in a first ply 62 within the first upper panel 42. The second upper panel 44 is further comprised of a second ply 64 and a foldable winged layer 66. Additionally, a third ply 68 is foldably connected to the second ply 64. The third ply 68 has a "U"-shaped notch 70 which is centrally positioned in the third ply 68.

Summarizing the description of the unfolded box 26 of the prior art in FIG. 2, the box 26 is comprised of the small spout 28, the first, second and third plies 62, 64, and 68, and a rectangular large material pattern 30.

Figure 3:
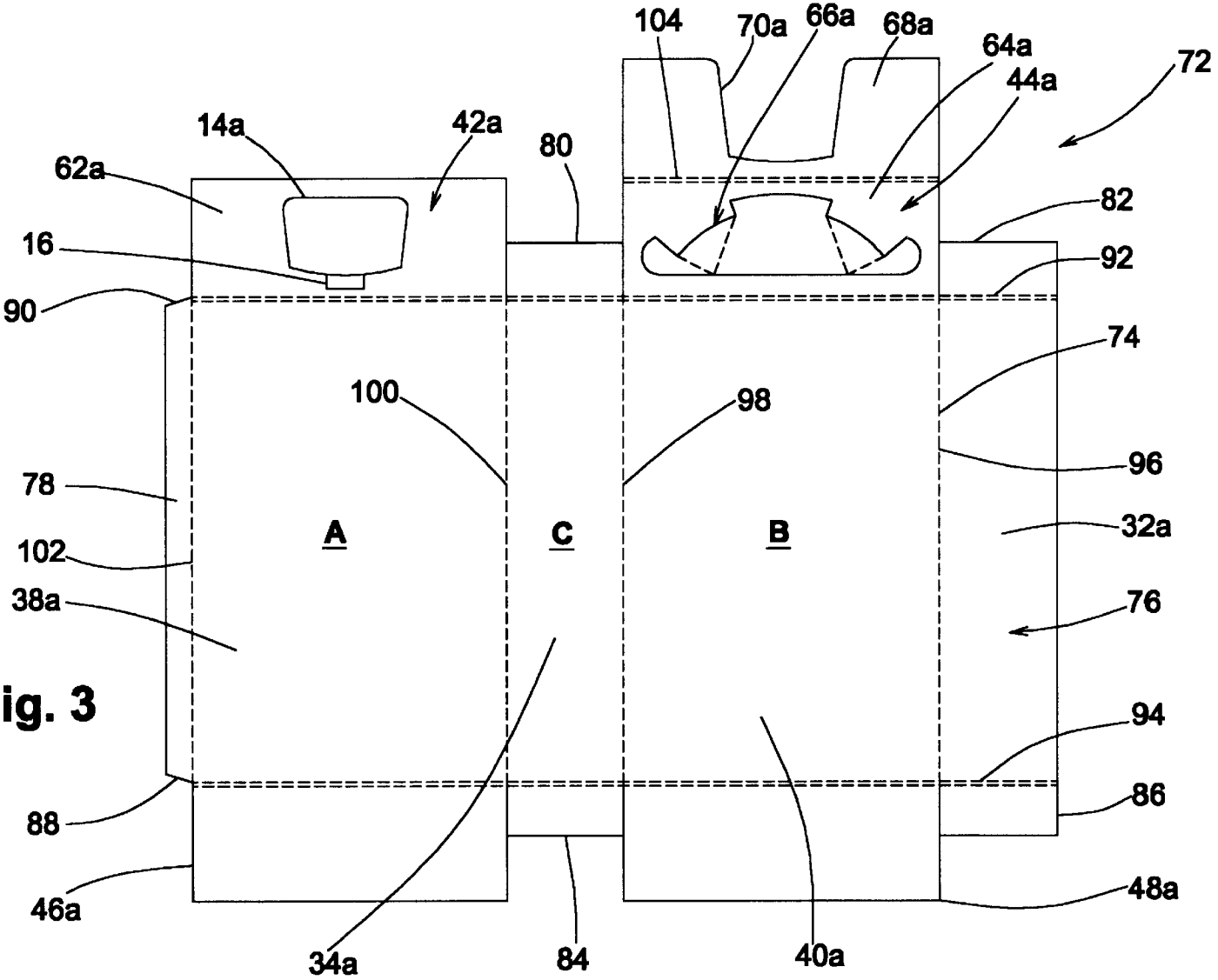
FIG. 3 is a schematic representation of the present invention in a flat open position, illustrating a scoring pattern, the enlarged spout, and an improved feature using less paperboard, according to the present invention.

Now referring to FIG. 3, a schematic representation of one embodiment of the present invention is shown of an open box 72 in a flat configuration, illustrating a scoring pattern 74, the underside 14*a* of the novel enlarged spout 14, and an improved construction pattern feature using less paperboard, according to the present invention. The enlarged spout 14 is novel when compared to the prior art (as illustrated in prior FIG. 2) because the novel spout 14 now allows for quick and easy pouring of large particle contents of the box 10 such as large flake breakfast cereals. No longer does a user need to reach into the box with one's fingers to pull out the flakes blocking the spout. More specifically in describing FIG. 3, a novel small material pattern 76 is comprised of a first and second end panel 32*a*, 34*a*, and a third end panel flap 78 foldably connected to a first and second side panel 38*a*, and 40*a*, which in turn are foldably connected to a first and second upper panel 42*a*, and 44*a*, a first and second bottom panel 46*a*, and 48*a*, and a first, second, third and fourth dust flap 80, 82, 84, and 86. The third end panel flap 78 also has two angled ends 88, and 90. Note that the small pattern 76 is irregular when compared to the rectangular large pattern 30 as described in previous FIG. 2. Also note that the first, second, third, and fourth dust flaps 80, 82, 84, and 86 and the third end panel flap 78 are smaller than the comparable dust flaps 52, 54, 58, and 60 and the third end panel 36 in FIG. 2. The first, second, third and fourth dust flaps 80, 82, 84, and 86 are rectangular, rather than square in prior art. In addition, the third end panel flap 78 is a narrow strip of material, rather than a rectangle as in prior art. Therefore, the dust flaps 80, 82, 84, and 86 and the third end panel 78 have less material than prior art. This novel small material pattern 76 saves money in material costs, yet still permits an easily and quickly assembled box 10.

Continuing with FIG. 3, the enlarged spout 28 is centrally located in a first ply 62*a* within the first upper panel 42*a*. The second upper panel 44*a* is further comprised of a second ply 64*a* and a foldable winged layer 66*a*. Additionally, a third ply 68*a* is foldably connected to the second ply 64*a*. The third ply 68*a* has a "U"-shaped notch 70*a* centrally positioned in the third ply 68*a*.

More specifically, in FIG. 3., the first side panel 38*a* is labeled A, the second side panel 40*a* is labeled B. and the second end panel 34*a*, is labeled C. These labels will assist in understanding the box assembly method to be described later.

Now referring more specifically to the scoring pattern 74, in FIG. 3., a sectional representation of the present invention illustrating the typical scoring pattern and more particularly the areas of female scoring, according to the present invention, open box 72 is shown in a cut and scored for folding, but unfolded and flat position. There are first and second horizontal female scores 92 and 94, shown as broken lines, as well as four vertical scores 96, 98, 100 and 102, also shown as broken lines, which may be male or female in orientation. All of the previously mentioned scores define box panels A, B and C. Cuts in the box 72 define the dust flaps 80, 82, 84, and 86. The first and second horizontal scores and the vertical scores 92, 94, 96, 98, 100, and 102, together with the cuts, define the box 72 lower panels 46*a*, and 48*a*, upper panels 42*a*, and 44*a* as well as the side panels 38*a*, and 40*a*. Finally, a third horizontal female score 104 in the open box 72 defines the third ply 68*a*.

Continuing with FIG. 3, a partial description of a method of making the box 10 is given. When folded during assembly, the open box 72 panels A and B become parallel to one another and perpendicular to panel C after being folded relative to two vertical scores 98, and 100. To complete the bottom of the box 72, the third dust flap 84 is folded up about female score 94, as are the first and second bottom panels 46*a*, and 48*a* following the third dust flap 84. In this way, the outer edges of the third dust flap 84, and all other dust flaps 80, 82, and 86 will fit snugly and quickly into the first and second female scores 92, and 94, providing a waterproof and sift proof box 10 and facilitating significantly more rapid and accurate assembly.

Summarizing the description of the open box 26 of the present invention in FIG. 3, the box 26 is comprised of the enlarged spout 28, the first, second and third plies 62*a*, 64*a*, and 68*a*, the scoring pattern 74, and the irregular small material pattern 76.

Figure 4:
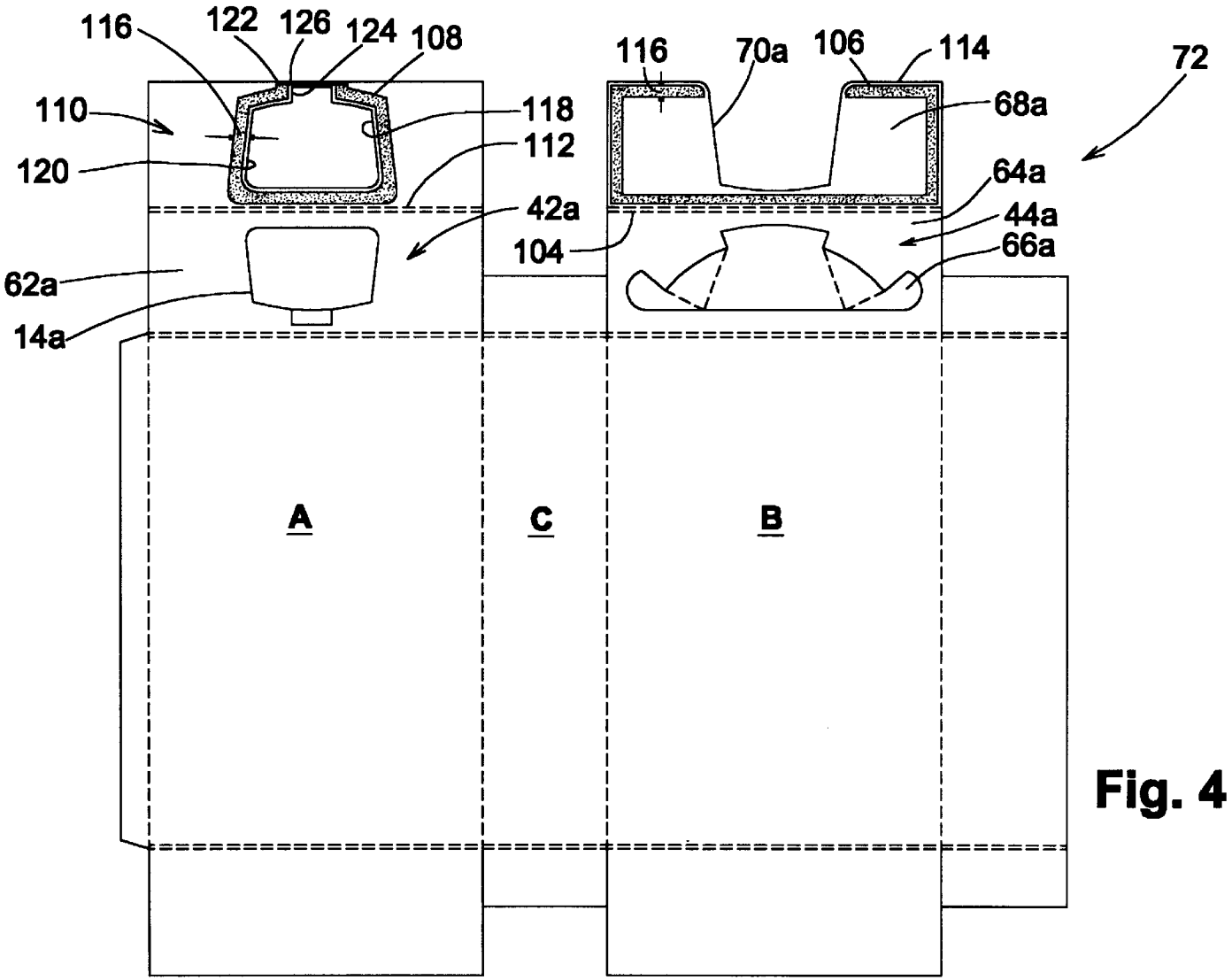
FIG. 4 is a schematic representation of the spout illustrating the 4-ply construction and a pattern of hot melt glue used to secure the four plies together, according to the present invention.

Referring now to FIG. 4, a schematic representation of a preferred embodiment of the enlarged spout 14 is shown illustrating a novel 4-ply construction and a first and a second hot melt glue pattern 106, and 108 according to the present invention. The four plies comprise the first ply 62*a*, second ply 64*a*, and third ply 68*a* as initially described in FIG. 3, plus a novel fourth ply 110. The fourth ply 110 is foldably connected to the first upper panel 62*a* about a fourth horizontal female score 112. The novelty in the 4-ply construction is that it provides a highly water resistant seal to the box 10. Prior art was able to provide moisture-resistant and sift-resistant sealing. However, the present invention, is characterized by both a highly water resistant and sift-proof sealing when combined with the novel new glue patterns to be described herein.

The first hot melt glue pattern 106 is applied during the assembly process around almost an entire third ply perimeter 114. The first glue pattern 106 stops at the "U"-shaped notch 70*a*. More specifically, a first width W 116 of the first glue pattern 106 is uniformly applied about the third ply perimeter 114. Most preferably, the first width W 116 has a dimension of about 1/16 to 1/32 of an inch.

Continuing to describe FIG. 4, the fourth ply 110 is of identical dimensions as the first ply 42*a*. Additionally, centrally located in the fourth ply 110 is an opening 118 identically sized to the underside 14*a* of spout 14. Similar in concept to the first glue pattern 106 on the third ply 68*a*, the second glue pattern 108 is applied around a fourth ply perimeter 120 to the opening 118. More specifically, the first width W 116 of the first glue pattern 106 is identical to a second width W 116 uniformly applied about the fourth ply perimeter 120, until the second glue pattern 108 reaches a top portion 122 of an outer finger notch 124. The top portion 122 has a third width W 126 preferably 1/64 of an inch. The third width is shown clearly in FIG. 6. Most preferably, the second width W 116 has a dimension of about 1/16 to 1/32 of an inch for most of the fourth perimeter 120. The significance of the widths of the glue patterns is that they provide the best known seal for the box 10 to provide the highly water resistant and sift-proof characteristics. Note that this FIG. 4 represents an early step in the method of assembly of the box 10. After creation of the basic material pattern, with the four plies, 42*a*, 44*a*, 68*a*, and 110, the method applies the first two glue patterns 106, and 108.

The glue in all the glue patterns is 50% water and 50% latex, approved by FDA for food contact. The glue is also contact cement, is applied dry (cool) then reinstated (activated by heat) during the process of box formation. Since it is contact glue, it sticks very well to itself, not unlike rubber cement.

Figure 5:
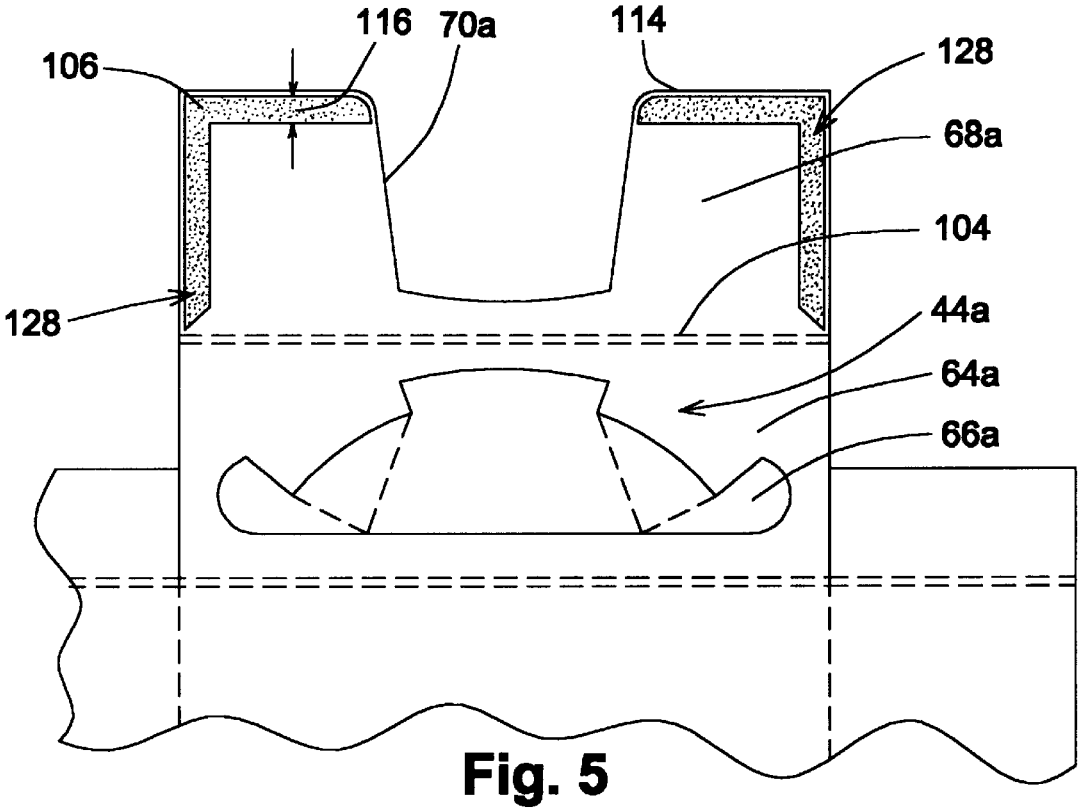
FIG. 5 is an enlarged partial schematic representation of the second and third plies illustrating another embodiment of a hot melt glue pattern used to secure the second and third plies together during assembly, according to the present invention.

Referring next to FIG. 5, an enlarged partial schematic representation of the second and third plies 64*a*, and 68*a* illustrating another embodiment of a hot melt glue pattern used to secure the second and third plies 64*a*, and 68*a* together during assembly, according to the present invention. This other embodiment of a hot glue pattern is a third glue pattern 128 that resembles two inverted "L"-shapes as viewed in this FIG. 5. The third glue pattern 128 is just as effective for waterproofing and sift-proofing as the previously described first glue pattern 106.

Figure 6:
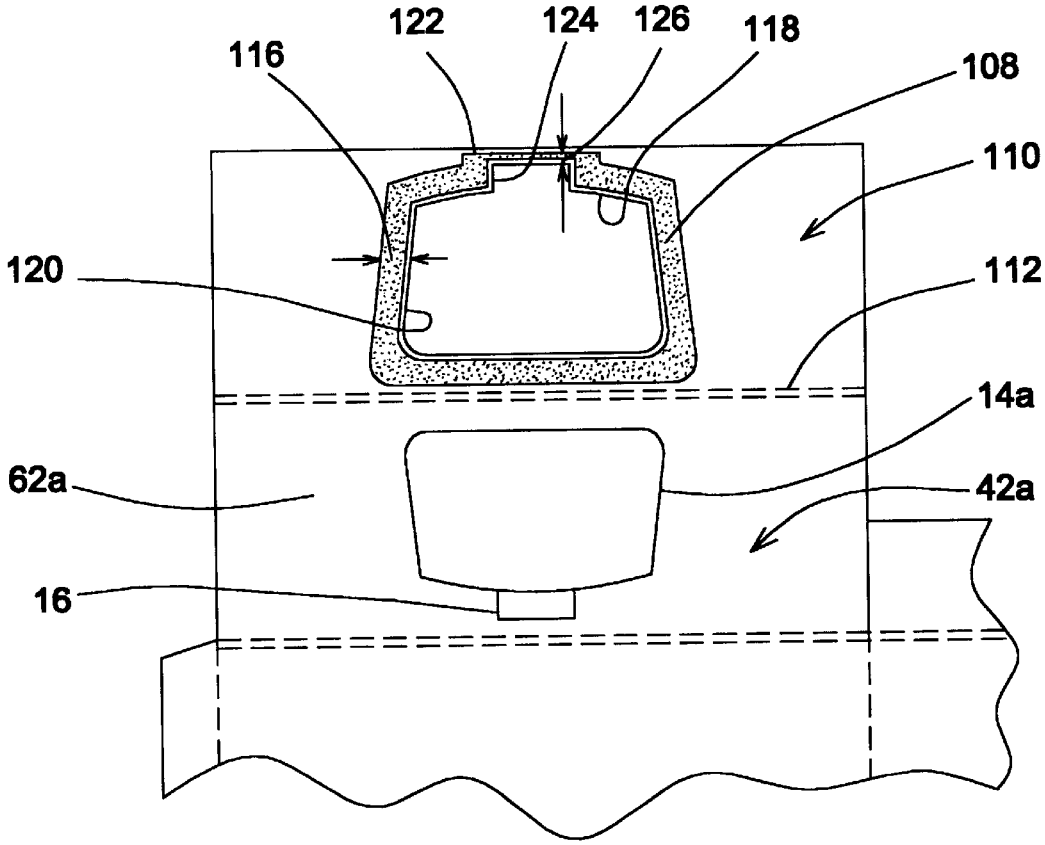
FIG. 6 is an enlarged partial schematic representation of the first and fourth plies illustrating the use of another glue pattern to secure the first and fourth plies together during assembly, according to the present invention.

Now referring to FIG. 6, an enlarged partial schematic representation is shown of the first and fourth plies 62*a*, and 110 illustrating the pattern of hot melt glue used to secure the first and fourth plies 62*a*, and 110 together during assembly, according to the present invention. Now more clearly shown in this FIG. 6, is the top portion 122 with the third width W 126, preferably 1/64 of an inch. Glue is also applied along the top portion 122 on the third width W 126.

Figure 7:
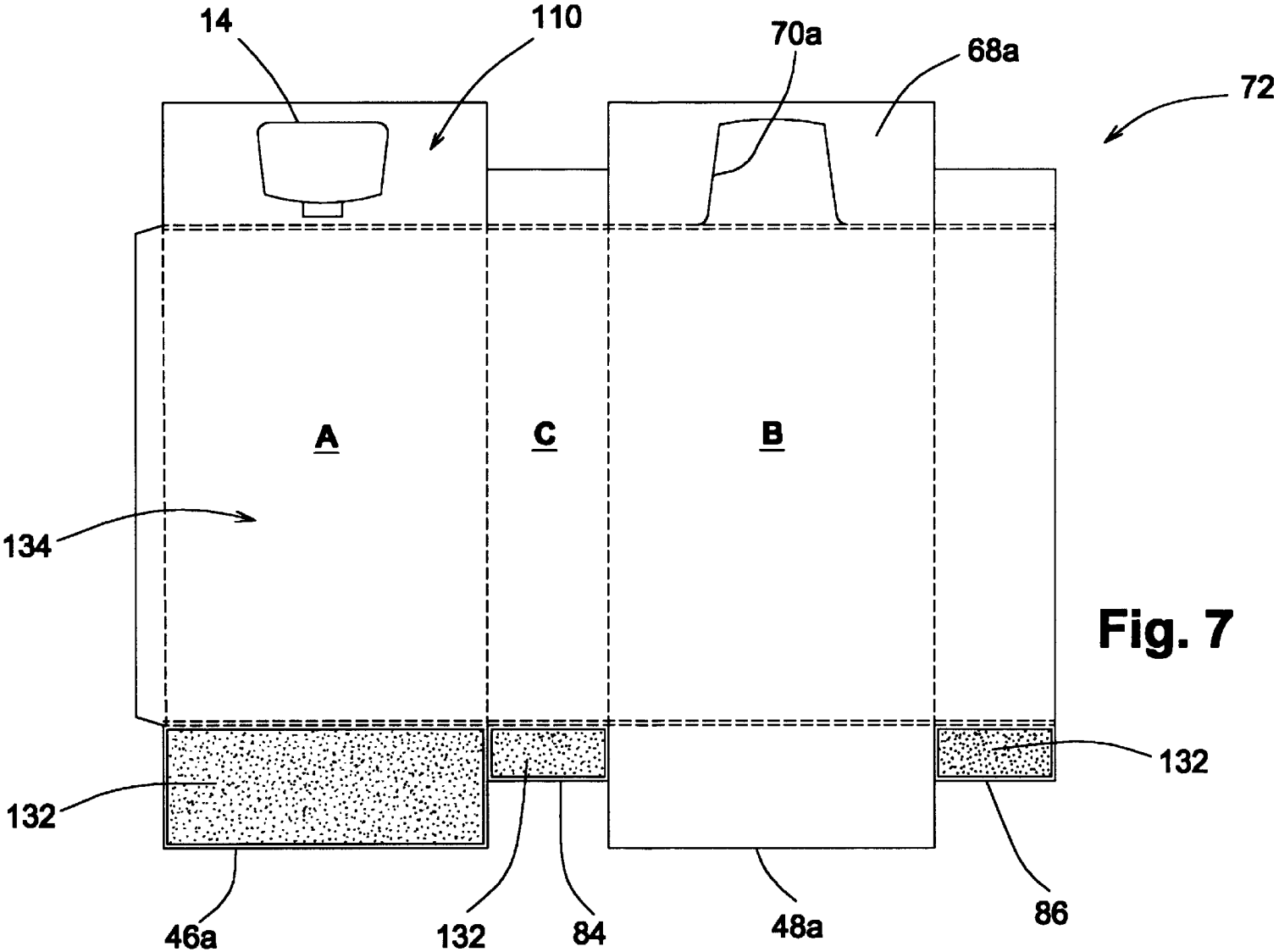
FIG. 7 is a schematic representation of the present invention in a flat open position, illustrating a first side bottom panel glue pattern, according to the present invention.

Next referring to FIG. 7 a schematic representation of the present invention is shown in a flat open position, illustrating a first side bottom panel glue pattern 132, according to the present invention. A first side 134 is designated to more clearly describe the method of assembly. The bottom panel glue pattern 132 is applied on the entire surface of the first bottom panel 46*a*. In addition, the bottom panel glue pattern is applied to both the first sides of the third and fourth dust flaps 84, and 86.

Continuing with FIG. 7, note that the fourth ply 110 and the third ply 68*a* are the only two of the four plies 62*a*, 64*a*, 68*a*, and 110 shown. The reason is that at this step of the method of assembly, the fourth ply 110 has been folded over the first ply 62*a*, while the third ply 68*a* has been folded over the second ply 64*a*.

The cardboard for the box 10 is coated with a water base coating approved by the FDA for food. Specifically, the coating may be that designated Michelman 763-R. During the assembly process, the application technique for the coating is the flexographic printing of adhesive technique. Also typically called the "flexo" technique, it has not been thought of or applied as a sealing technique, in this particular pattern, to this type of box 10 before. Therefore, applying novel glue patterns in this way is a novel technique.

The thick 4-ply spout 14 seals better with less warpage (so it functions better because of no warping). Because of the both the several glue patterns and the coating on the paperboard, there is virtually no need for an inner bag (as typically found to protect cereals). The box 10 is waterproof and sift-proof. Additionally a clear plastic label is applied over the top of the spout 14 during the assembly process. More specifically, a label machine is used to apply the final clear label on the spout 14.

Figure 8:
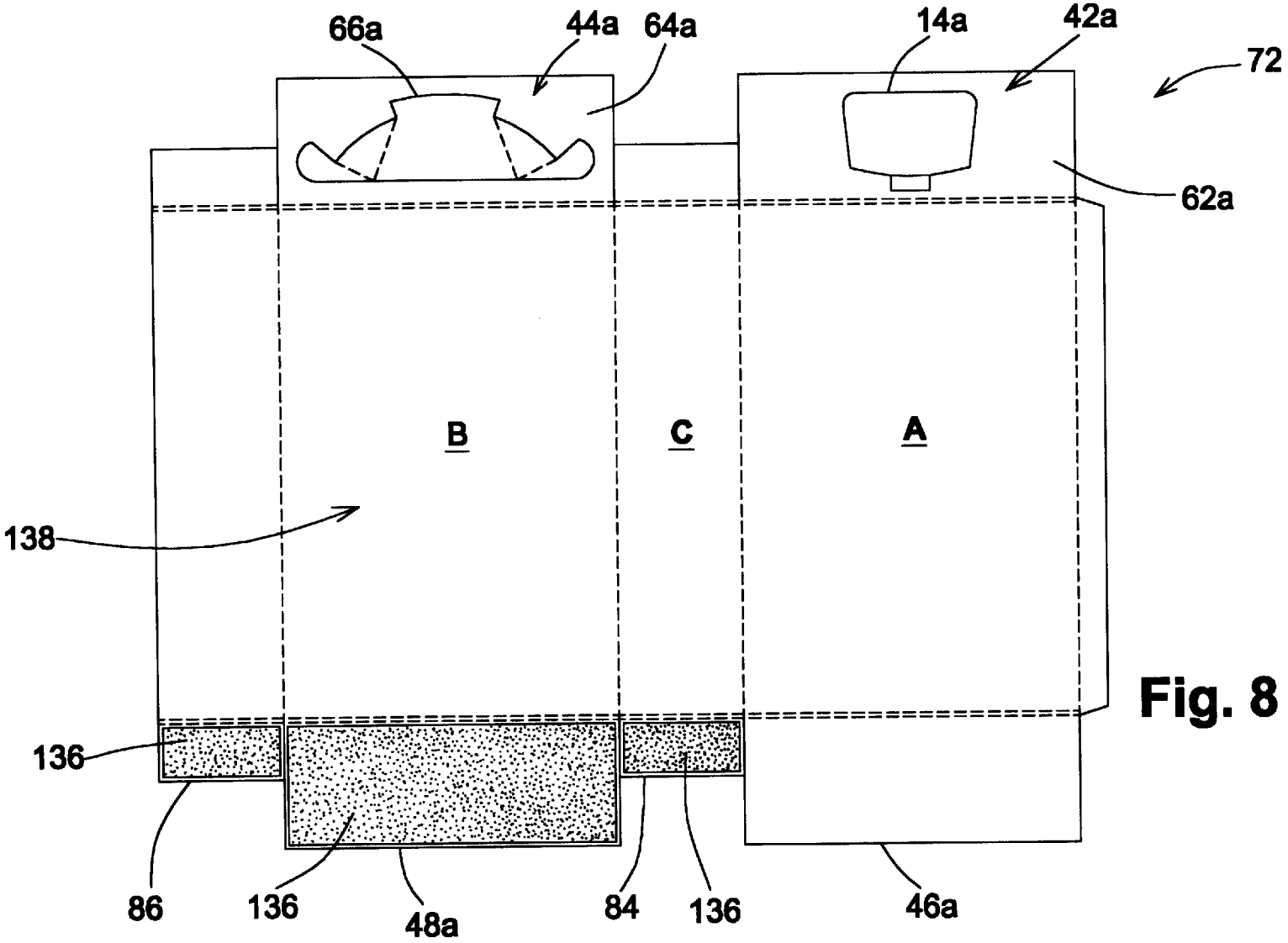
FIG. 8 is a schematic representation of the present invention in a flat open position, illustrating a second side bottom panel glue pattern, according to the present invention.

Referring now to FIG. 8, a schematic representation of the present invention is shown in a flat open position, illustrating a second side bottom panel glue pattern 136, according to the present invention. A second side 138 is designated to more clearly describe the method of assembly. The second side bottom panel glue pattern 136 is applied to the entire surface of the second bottom panel 48*a*. In addition, the second side bottom panel glue pattern 136 is applied to both the reverse sides (the second sides) of the third and fourth dust flaps 84, and 86.

Continuing with FIG. 8, note that the first ply 62*a* and the second ply 64*a* are the only two of the four plies 62*a*, 64*a*, 68*a*, and 110 shown. The reason is that at this step of the method of assembly, the fourth ply 110 has been folded under the first ply 62*a*, while the third ply 68*a* has been folded under the second ply 64*a*. This FIG. 8 is the second or reverse side of the open box 72.

Figure 9:
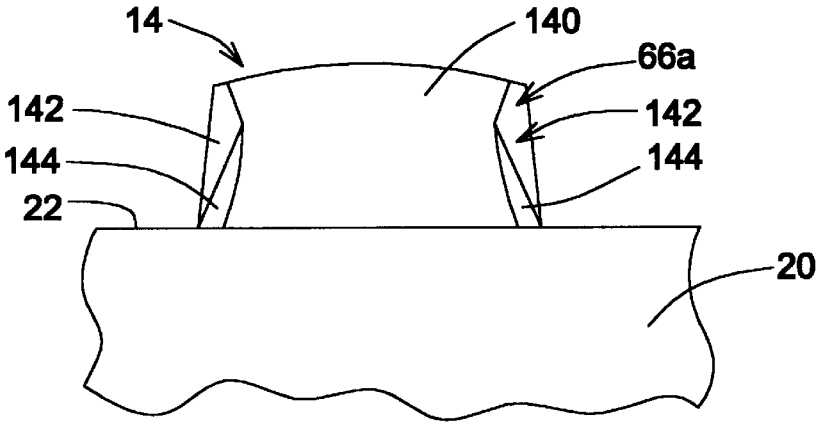
FIG. 9 is a fragmentary schematic front view of the spout, illustrating an open position of the spout, according to the present invention.

Next, referring to FIG. 9, a fragmentary schematic front view of the spout 14 is shown, illustrating an open position of the spout 14, according to the present invention. The spout 14 rises above the top perimeter 22 of the side panel 20. Additionally, an underside 140 of the spout 14 is clearly shown. The foldable winged layer 66*a* is also more clearly illustrated as further comprising a first wing portion 142 and a second wing portion 144. The two wing portions 142, and 144 unfold upon opening of the spout 14 at a scoring or perforation between the two portions 142, and 144, yet not seen in this FIG. 9. Additionally, upon closing of the spout 14, the two wing portions 142, and 144 fold down upon each other into the box 10.

Figure 10:
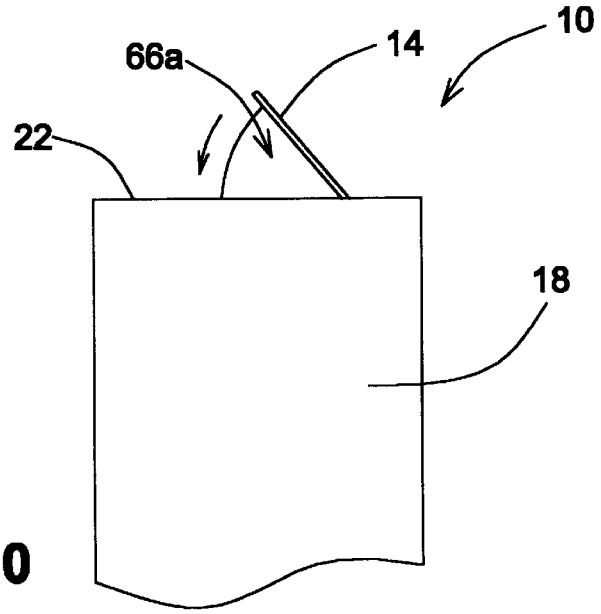
FIG. 10 is a fragmentary schematic side view of the spout, illustrating the open position of the spout, according to the present invention.

Lastly referring to FIG. 10, a fragmentary schematic side view of the spout 14 is shown, illustrating the open position of the spout 14, according to the present invention. Also more clearly seen in this FIG. 10, is the foldable winged layer 66*a* in the completely raised (vertical) and locked position above the end panel 18. The winged layer 66*a* functions to lock the spout 14 in the open position. Just one advantage of this novel spout 14 is the quick and easy opening and snapping into place, thereby allowing immediate pouring of the contents of the box 10.

Continuing with FIG. 10, an arrow arcing downwardly toward the top perimeter 22 of the box 10 illustrates the motion of the spout 14 when being closed. When a user pushes on the spout 14 until it is closed, it is effectively locked into the box 10. Another clear advantage of this unique spout 14 is the snapping closed action. Once closed, the contents are highly water resistant and sift-proof. And because of the 4-ply construction, the spout 14 is very strong yet inexpensive to manufacture. In addition, the spout 14 strength allows repeated openings and closings without damaging the spout 14 or compromising its integrity. In this way, the inventive improved spout as described herein, is more durable than other spouts as described in the prior art.

Method of Assembly

The method of assembling the box 10 will now be more fully described than the description set forth in FIG. 3 above. A summary of the steps of the method or process include the following:

1. Fabricating a small irregular material pattern 76.
2. Scoring the material pattern 76.
3. Coating the material pattern 76.
4. Applying a first glue pattern 106 to the fourth ply 110.
5. Applying a second glue pattern 108 to the third ply 68*a*.
6. Applying a first side bottom panel glue pattern 132 to an entire surface of a first bottom panel 46*a*.
7. Applying the first side bottom glue pattern 132 to first sides of the third and fourth dust flaps 84, and 86.
8. Turning the material pattern 76 over to a second side 138.
9. Applying a second side bottom panel glue pattern 136 to an entire surface of a second bottom panel 48*a*.
10. Applying the second side bottom glue pattern 136 to second sides of the third and fourth dust flaps 84, and 86.
11. Folding the box 10.
12. Affixing a clear adhesive removable plastic label over the spout 14.

A further more detailed description of the assembly process is now given. The steps include the following:

1. Fabricating a small irregular material pattern 76. The pattern 76 comprises a first and second end panel 32*a*, and 34*a*, a third end panel flap 78 foldably connected to a first and second side panel 38*a*, and 40*a*, which in turn are foldably connected to a first and second upper panel 42*a*, and 44*a*, a first and second bottom panel 46*a*, and 48*a*, and a first, second, third and fourth dust flap 80, 82, 84, and 86. The third end panel flap 78 also comprises two angled ends 88, and 90. In addition, the first, second, third and fourth dust flaps 80, 82, 84, and 86 are rectangular. Also, the third end panel flap 78 is a narrow strip of material. The first upper panel 42*a* comprises a spout 14 further comprising a first, second, third, and fourth ply 62*a*, 64*a*, 68*a*, and 110.

2. Scoring the material pattern 76. Scoring comprises first and second horizontal female scores 92, and 94, and four vertical scores 96, 98, 100, and 102. The vertical scores 96, 98, 100, and 102 are one of either male or female orientation. Also, the scoring further defines box 10 panels A, B and C. A plurality of cuts in the box 10 define the four dust flaps 80, 82, 84, and 86. Also, the first and second horizontal scores 92, and 94 and the vertical scores 96, 98, 100, and 102, together with the cuts, define the two lower or bottom panels 46*a*, and 48*a*, the two upper panels 42*a*, and 44*a*, and the two side panels 38*a*, and 40*a*. The scoring also comprises a third and fourth horizontal female score 104, 112 defining the third ply and the fourth ply 68*a*, and 110.

3. Coating the material pattern 76 with a water base coating.

4. Applying a first glue pattern 106 to the fourth ply 110.

5. Applying a second glue pattern 108 to the third ply 68*a*.

6. Applying a first side bottom panel glue pattern 132 to an entire surface of a first bottom panel 46*a*.

7. Applying the first side bottom glue pattern 132 to first sides of the third and fourth dust flaps 84, and 86.

8. Turning the material pattern 76 over to a second side 138.

9. Applying a second side bottom panel glue pattern 136 to an entire surface of a second bottom panel 48*a*.

10. Applying the second side bottom glue pattern 136 to second sides of the third and fourth dust flaps 84, and 86.

11. Folding the box 10, wherein the box 10 panels A and B become parallel to one another and perpendicular to panel C after being folded relative to two vertical scores, and further wherein the fourth ply 110 is folded over the first ply 62*a*, and the third ply 68*a* is folded over the second ply 64*a*. To complete assembly, the third dust flap 84 is folded up about a female score as are the first and second bottom panels 46*a*, and 48*a*, thereby permitting the third dust flap 84 and all other dust flaps to fit snugly and quickly into first and second female scores 92, and 94, and also thereby providing a waterproof and sift-proof box 10 and facilitating significantly more rapid, accurate and inexpensive assembly.

12. Affixing a clear adhesive removable plastic label over the spout 14.

The present invention improves the construction and assembly of cartons, and thereby provides solutions to the many problems associated previously with box design and construction. Novel improvements have been clearly described to a box for waterproofing the contents against moisture, and unwanted leakage of the contents. Improvements to the spout, to the gluing arrangement, and to the scoring procedure have been provided. No longer will the user have to discard purchases because of inedible or unusable contents. No longer will the manufacture of the boxes have to manage so many parts and assemblies. And no longer will the user be as frustrated with difficult to seal boxes. These unique improvements also mean that the frequent use of a waxed paper or paper-like bag can be virtually eliminated from the manufacturing process, thereby reducing costs. At the same time, the great user frustration of opening the bag within the box is also eliminated.

Consequently, while the foregoing description has described the principle and operation of the present invention in accordance with the provisions of the patent statutes, it should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. A box comprising:

two side panels; a top panel; a bottom panel; and two end panels; and a pouring spout;

wherein said panels are foldably connected to each other, and wherein said spout is centrally located in said top panel, and further wherein said spout includes means for opening to an open position, said spout having a foldable winged layer, said winged layer includes a first wing portion and a second wing portion, said first and second wing portions permitting folding of said first and second wing portions at perforations in said foldable winged layer, thereby allowing said first and second wing portions to unfold and fold vertically when said spout is opened and closed respectively, and further wherein said spout includes a first, second, third, and fourth ply, whereby during assembly all of said four plies are folded upon each other, and glued together, thereby providing a water resistant spout.

2. A box having a 4-ply spout according to claim 1, wherein said 4-ply spout is constructed in an enlarged configuration to accommodate pouring and retention of large particle box contents.

3. A box comprising:

two side panels; a top panel; a bottom panel; two end panels; and multiple dust flaps, said box having a flat pattern during manufacture and before assembly, said flat pattern having horizontal scores and vertical scores to facilitate folding, said horizontal scores being female scoring formed at the juncture between each of said panels, said vertical scores being male scoring formed at the juncture between each of said panels, said top panel comprising a spout further comprising a first, second, third, and fourth ply, each of said plies being in a folded relationship after said box is assembled, wherein said first and said fourth ply having horizontal scoring between them, and wherein said second and third plies have a horizontal scoring between them, thereby allowing said plies to fold upon each other during assembly, thereby providing a waterproof box.

4. A box having a spout according to claim 3, wherein the spout is constructed in an enlarged configuration to accommodate pouring and retention of large particle container contents.

5. A box having a spout according to claim 3, and further wherein said spout comprises means for opening to an open position, and further wherein said spout further comprises a foldably winged layer, said winged layer further comprising a first and second wing portions, said wing portions further comprising means for permitting folding of said wing portions at perforations in said winged layer, thereby allowing said wing portions to unfold and fold vertically when said spout is opened and closed respectively.

6. A box according to claim 3, wherein said box is constructed from a material blank by folding the pattern for cut-out and construction of said box having a 4-ply spout comprising:

an irregular small material pattern, wherein said pattern is comprised of a first and second end panel, and a third end panel flap foldably connected to a first and second side panel, which in turn are foldably connected to a first and second upper panel, a first and second bottom panel, and a first, second, third and fourth dust flap, wherein said third end panel flap also comprises two angled ends, and further wherein said first, second, third and fourth dust flaps are rectangular in shape and shorter in overall length than said upper and bottom panels to allow for lateral nesting in multiple pattern configurations of paperboard material, for the purpose of conserving box construction materials and facilitating more rapid cutting procedures, and further wherein said third end panel flap is a narrow strip of material thereby along with said shorter dust flaps, utilizing less material for construction of said box using said irregular small material pattern.

7. A box having a spout comprising:

two side panels; a top panel; a bottom panel; two end panels; and multiple dust flaps, said box having a flat pattern during manufacture and before assembly, said flat pattern having horizontal scores and vertical scores to facilitate folding, said horizontal scores being female scoring formed at the juncture between each of said panels, said vertical scores being male scoring formed at the juncture between each of said panels, said top panel comprising a spout further comprising a first, second, third, and fourth ply, each of said plies being in a folded relationship after said box is assembled, wherein said first and said fourth ply having horizontal scoring between them, and wherein said second and third plies have a horizontal scoring between them, thereby allowing said plies to fold upon each other during assembly, thereby providing a waterproof box, and further wherein a first hot melt glue pattern is applied during the assembly process around almost said entire third ply perimeter, wherein said first glue pattern stops at a "U' shaped notch, and further wherein a second glue pattern is applied around a perimeter of said fourth ply to an opening in said fourth ply until said second glue pattern reaches a top portion of an outer finger notch, and further wherein glue is applied around said top portion of said outer finger notch, and further wherein a first side bottom panel glue pattern is applied on a first side, and further wherein said first side bottom panel glue pattern is applied on an entire surface of said first bottom panel, and further wherein said bottom panel glue pattern is applied to both the first sides of said third and fourth dust flaps, and further wherein a second side bottom panel glue pattern is applied on a second side, and further wherein said second side bottom panel glue pattern is applied to the entire surface of said second bottom panel, and further wherein said second side bottom panel glue pattern is applied to both the second sides of said third and fourth dust flaps.

8. A box having a spout according to claim 7, wherein the spout is constructed in an enlarged configuration to accommodate pouring and retention of large particle container contents.

9. A box having a spout according to claim 8, wherein said spout comprises means for opening to an open position, and further wherein said spout further comprises a foldably winged layer, said winged layer further comprising a first and second wing portions, said wing portions further comprising means for permitting folding of said wing portions at perforations in said winged layer, thereby allowing said wing portions to unfold and fold vertically when said spout is opened and closed respectively.

10. A box having a spout according to claim 7, wherein a third hot melt glue pattern is applied during the assembly process, said third glue pattern resembles two inverted "L" shapes, and further wherein said third glue pattern stops at a "U"-shaped notch.

11. A method of assembling a box comprising the steps of:

(a) fabricating an irregular material pattern, said pattern comprising a first and second end panel, a third end panel flap foldably connected to a first and second side panel, which in turn are foldably connected to a first and second upper panel, a first and second bottom panel, and a first, second, third and fourth dust flap, and wherein said third end panel flap also comprises two angled ends, and further wherein said first, second, third and fourth dust flaps are rectangular, and further wherein said third end panel flap is a narrow strip of material, and further wherein said first upper panel comprises a spout further comprising a first, second, third, and fourth ply;

(b) scoring said material pattern, wherein said scoring comprises first and second horizontal female scores, four vertical scores, said vertical scores being one of either male or female orientation, said scoring further defining box panels A, B and C, and further wherein a plurality of cuts in said box define four dust flaps, and further wherein said first and second horizontal scores and said vertical scores, together with said cuts, define two lower panels, two upper panels, and two side panels, and further wherein said scoring comprises a third and fourth horizontal female score defining said third ply and said fourth ply;

(c) coating said material pattern with a water base coating;

(d) applying a first glue pattern to said fourth ply;

(e) applying a second glue pattern to said third ply;

(f) applying a first side bottom panel glue pattern to an entire surface of a first bottom panel;

(g) applying said first side bottom glue pattern to first sides of said third and fourth dust flaps;

(h) turning said material pattern over to a second side;

(i) applying a second side bottom panel glue pattern to an entire surface of a second bottom panel;

(j) applying said second side bottom glue pattern to second sides of said third and fourth dust flaps;

(k) folding said box, wherein said box panels A and B become parallel to one another and perpendicular to panel C after being folded relative to two vertical scores, and further wherein said fourth ply is folded over said first ply, and further wherein said third ply is folded over said second ply, and further wherein to complete assembly, said third dust flap is folded up about a female score as are said first and second bottom panels, thereby permitting said third dust flap and all other dust flaps to fit snugly and quickly into said first and second female scores, and also thereby providing a waterproof and sift-proof box and facilitating significantly more rapid and accurate assembly; and (l) affixing a clear adhesive removable plastic label over said spout.

12. The method of assembling a box according to claim 11, wherein all of said glue patterns that are applied to all of said plies, said dust flaps, and said panels, includes glue that is about 50% water and about 50% latex.

* * * * *